United States Patent [19]

Mailand et al.

[11] 4,447,989

[45] May 15, 1984

[54] ADJUSTABLE WEATHERSTRIP ASSEMBLY

[75] Inventors: John J. Mailand, Wyoming Township, Chicago County; Bruce E. Samuelson, West Lakeland Township, Washington County, both of Minn.

[73] Assignee: Minnesota Mining and Manufacturing Company, St. Paul, Minn.

[21] Appl. No.: 358,835

[22] Filed: Mar. 16, 1982

[51] Int. Cl.[3] ..... E06B 7/16

[52] U.S. Cl. ..... 49/488; 49/482; 49/499

[58] Field of Search ..... 49/488, 489, 498, 499, 49/482, 493

[56] References Cited

U.S. PATENT DOCUMENTS

| | | | |
|---|---|---|---|
| 1,048,407 | 12/1912 | Godfrey . | |
| 2,583,978 | 1/1952 | Watter et al. . | |
| 2,880,477 | 4/1959 | Kunkel . | |
| 3,041,682 | 7/1962 | Alderfer et al. . | |
| 3,448,543 | 6/1969 | Multer | 49/488 X |
| 3,518,793 | 7/1970 | Airtle | 49/488 |
| 3,854,246 | 12/1974 | McAllister | 49/488 X |
| 3,987,587 | 10/1976 | Miller | 49/493 |
| 4,084,348 | 4/1978 | Hast | 49/475 |
| 4,185,417 | 1/1980 | McKann | 49/488 X |
| 4,240,228 | 12/1980 | Okamura | 49/498 X |

*Primary Examiner*—Kenneth Downey

*Attorney, Agent, or Firm*—Donald M. Sell; James A. Smith; William L. Huebsch

[57] ABSTRACT

A weatherstrip assembly comprising an integral extrusion of polymeric material comprising a stiff L-shaped portion adapted to engage around an edge of the door, a flexible, resilient central strip-like portion, a stiff third strip-like portion extending from the edge of the second portion opposite the first portion, and a strip-like flexible flap portion having an edge joined at the juncture between the second and third portions. The first portion is adhered to a door by pressure-sensitive adhesive, the third portion is positioned in face-to-face contact with the outer surface of the first portion opposite the surface of the door and adjusted in a vertical direction with respect to said door to form the flexible second portion into a tube-like structure having a sufficient diameter to fill a void space between a frame and the edge of the door, and the first and second portions are attached in place by screws. The outer edge of the flap portion will then contact the frame and provide an outer seal in addition to that provided by the tube-like structure.

7 Claims, 4 Drawing Figures

ADJUSTABLE WEATHERSTRIP ASSEMBLY

TECHNICAL FIELD

This invention relates to weatherstrip assemblies for use on doors, and particularly to such assemblies for use between a door and the sill or frame adjacent the door that are adjustable to accommodate the space therebetween.

DISCLOSURE OF INVENTION

The present invention provides an inexpensive, effective, easily installable weatherstrip assembly for use between an edge surface of a door and a sill or frame adjacent the door, which assembly is easily adjustable to accommodate various sized spaces between the door and the sill or frame.

The weatherstrip assembly according to the present invention comprises an integral extrusion of polymeric material comprising (1) a first stiff portion including first and second strip-like parts disposed at right angles to each other to provide a general L-shaped cross-section; (2) a second resiliently flexible central strip-like portion extending from the edge of the second part opposite the first part; and (3) a third stiff strip-like portion extending from the edge of the second part opposite the first portion. A layer of pressure-sensitive adhesive can be provided on the surface of one of the parts and used to adhere the first portion to a door with the first part along a side surface of the door and the second part along the edge surface of the door. The third part is adapted to then be positioned in face-to-face contact with the surface of the first part opposite the door and to be adjusted to a desired position so that the second part and the flexible second portion form a resiliently compressible tube-like structure having a sufficient diameter to fill the space between the edge surface of the door and the sill or frame. Means such as screws are provided for attaching the first and third portions to the door with the third portion in the desired position.

Preferably, the extrusion also includes a flexible strip-like flap portion attached by one edge at the juncture between the second and third portions so that it projects generally along the second portion. When the assembly is properly attached to a door, the outer edge of the flap portion will seal against the frame or sill to provide a second outer seal in addition to the seal provided by the tube like structure, and will restrict migration of rain or snow between the tube like structure and the frame or sill.

Also, preferably the extrusion includes a lip along the edge of the third portion opposite the second portion positioned to project toward the door when the third part is in face-to-face contact with the first part to cover and obscure the edge of the first part opposite the second part, thereby restricting the entry of rain or snow between the assembly and a door and improving the esthetic appearance of the assembly on the door.

BRIEF DESCRIPTION OF THE DRAWING

The present invention will be further described with reference to the accompanying drawing wherein like reference numerals refer to like parts in the several views, and wherein.

DESCRIPTION OF THE PREFERRED EMBODIMENT

Figure 1:
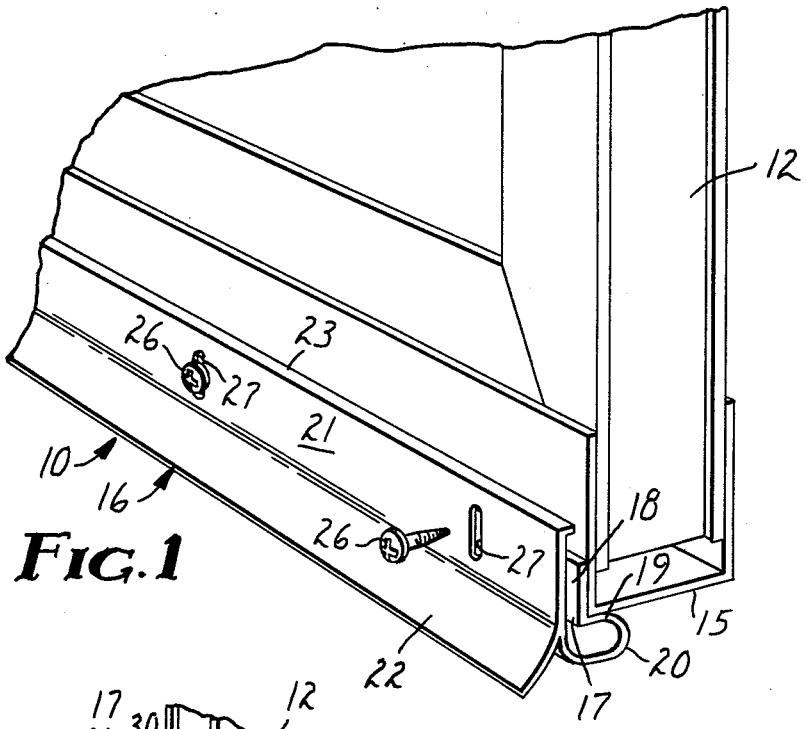
FIG. 1 is a fragmentary perspective view of a weatherstrip assembly according to the present invention attached to the bottom of a storm door.
Figure 2:
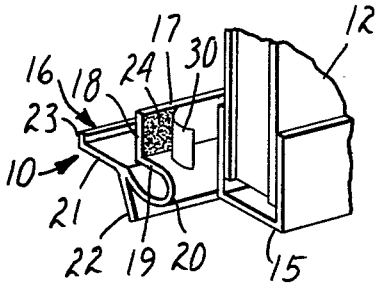
FIG. 2 is a fragmentary perspective view of the weatherstrip assembly and door shown in FIG. 1 prior to attachment of the weatherstrip assembly to the door.

Referring now to the drawing there is illustrated an adjustable weatherstrip assembly according to the present invention, generally designated by the reference numeral 10. The assembly 10 is shown attached between a bottom portion of a storm door 12 on its outer surface, and a frame or sill 14 adjacent an edge surface 15 of the door 12.

The weatherstrip assembly 10 comprises an integral polymeric extrusion 16, preferably of polyvinyl chloride. The extrusion 16 includes (1) a first stiff portion 17 including first and second strip-like parts 18 and 19 disposed at right angles to each other to provide a generally L-shaped cross section; (2) a second resiliently flexible central strip-like portion 20 extending from the edge of the second part 19 opposite the first part 18; and (3) a third stiff strip-like portion 21 extending from the edge of the second portion 20 opposite the first portion 17.

Also included in the extrusion 16 is a flexible strip-like flap portion 22 attached at one edge at the juncture between the second and third portions 20 and 21, and projecting generally along the second portion 20; and a lip 23 along the edge of the third portion 21 opposite the second portion 20, the functions of which will later be explained.

The extrusion 16 is extruded with the second part 19 of the first portion 17, the second portion 20 and the third portion 21 generally in the same plane. During such extrusion the first and third portions 17 and 21 are caused to be stiff while the central second portion 20 and flap 22 are caused to be flexible by introducing different polymeric compositions into the portions and flap by techniques well known in the extruding art.

As an example of such compositions, the stiff first and third portions 17 and 21 can be extruded from the composition commercially designated No. 85802 "Geon" and the central second portion 20 and flap 22 can be extruded from the composition commercially designated No. 83741 "Geon"; both of which compositions are available from B. F. Goodrich Co., Cleveland, Ohio.

The assembly 10 includes a layer 24 of pressure-sensitive adhesive on the surface of the first part 18 adjacent the second part 19. The first portion 17 is adapted to be adhered to the door 12 by the layer 24 of pressure-sensitive adhesive with its first part 18 along an outer side surface of the door 12, and its second part 19 along the edge surface 15 of the door 12. The third portion 21 is adapted to then be positioned in face-to-face contact with the surface of the first part 18 opposite the door 12 and to be positioned in a desired position at which the second part 19 and the flexible second portion 20 form a resiliently compressible tube-like structure having a diameter sufficient to fill the space adjacent the edge surface 15 of the door 12. Means in the form of screws 26 are provided for then permanently attaching the first and third portions 17 and 21 in the desired position on the door 12 to retain the desired shape of the tube-like structure. The third portion 21 has a plurality of spaced transverse slots 27 through which the screws 30 may extend to attach the assembly 10.

Figure 3:
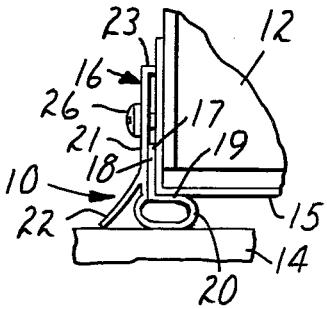
FIGS. 3 and 4 are fragmentary horizontal views of the weatherstrip assembly and door of FIG. 1 showing different adjustments of the assembly to accommodate different spacings between the door and a frame or sill adjacent the door.
Figure 4:
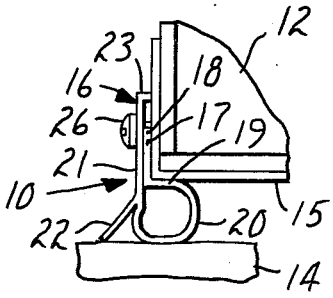

To install the weatherstrip assembly 10 a person first measures the width of the door to which the assembly 10 is to be attached and cuts the assembly to the appropriate length. He then removes a protective release liner 30 that is initially positioned over the layer 24 of adhesive and applies the first portion 17 to the door 12 so that the layer 24 of adhesive will then hold the first portion 17 in place. The person then moves the third portion 21 to a position in face-to-face contact with the surface of the first part 18 opposite the door 12 and moves it parallel to the side surface of the door 12 so that the second part 19 and second portion 20 form a flexible, compressible tube-like structure of a desired diameter adapted to seal between the edge surface of the door 12 and the sill 14. As can be seen in FIGS. 3 and 4, the tube-like structure may thus be caused to be a different size for this purpose. The user then attaches the first part 18 and third portion 21 to the door via screws 26 which he inserts centrally through the slots 27 and engages with the door 12. The slots allow some final adjustment just before the screws 26 are tightened. The screws 26 may or may not pass through the first part 18 depending on the desired location of the third portion 21, but will hold the first part 18 in place on the door 12. Thus, while the layer 24 of pressure-sensitive adhesive is convenient and preferred to assist attaching the weatherstrip assembly 10, it is not a necessity.

After such installation, the flap portion 22 will project generally outwardly of the door 12 away from the tube like structure formed by the second part 19 and central second portion 20. The outer edge of the flap portion 22 will seal against the sill 14 to provide a second outer seal in addition to the seal provided by the tube like structure, and will thus restrict migration of rain or snow between the tube like structure and the sill 14. Also, the lip 23 is positioned to project toward the door 12 to cover and obscure the edges of the first part 18 and layer 24 of adhesive opposite the second part 19 to thereby restrict the entry of rain or snow between the assembly 10 and the door 12 and to improve the esthetic appearance of the assembly 10 on the door 12.

We claim:

1. A weatherstrip assembly or use on an door having side and edge surfaces, said assembly comprising:

an integral extrusion of polymeric material comprising a first stiff portion including first and second strip-like parts disposed at right angles to each other to provide a general L-shaped cross section, a second resiliently flexible strip-like portion extending from the edge of said second part opposite said first part, and a third stiff strip-like portion extending from the edge of said second portion opposite said first portion;

said first portion being adapted to be positioned on said door with said first part along the side surface of the door and said second part along the edge surface of the door, and said third portion being adapted to then be positioned in face-to-face contact with the surface of said first part opposite said door and adjusted to a desired position so that said second part and said flexible second portion form a tube-like structure having a sufficient diameter to fill a void space adjacent the edge surface of said door; and means for attaching said first and third portions to the door with said third portion in said desired position.

2. A weatherstrip assembly according to claim 1, wherein said extrusion further includes a flexible flap portion attached at one edge generally at the juncture between said second and third portions and projecting generally along said second portion.

3. A weatherstrip assembly according to claim 1 further including a layer of pressure-sensitive adhesive on the surface of one of said parts adjacent the other of said parts adapted to adhere said first portion to a said door to facilitate installation of said assembly.

4. A weatherstrip assembly according to claim 1, claim 2, or claim 3 wherein said extrusion includes a lip along the edge of said third portion opposite said second portion positioned to project toward the door when said third part is in said face-to-face contact with said first part to obscure the edge of said first part opposite said second part.

5. A weatherstrip assembly according to claim 3 further including a release liner over said layer of pressure-sensitive adhesive.

6. A weatherstrip assembly according to claim 1 wherein said polymeric material is polyvinyl chloride.

7. A weatherstrip assembly according to claim 1, or claim 2, wherein said third portion has a plurality of transversely extending slots, and said means for attaching comprise screws adapted to extend through said slots to attach said third portion and first part to the door.

* * * * *